US006460186B1

(12) United States Patent
Dailly

(10) Patent No.: US 6,460,186 B1
(45) Date of Patent: Oct. 8, 2002

(54) SPORTSWEAR, IN PARTICULAR, FOR A CYCLIST

(76) Inventor: Gérard Dailly, 2, rue des Oies, 68000 Colmar (FR)

( * ) Notice: Subject to any disclaimer, the term of this patent is extended or adjusted under 35 U.S.C. 154(b) by 0 days.

(21) Appl. No.: 09/719,578

(22) PCT Filed: Jun. 15, 1999

(86) PCT No.: PCT/FR99/01411

§ 371 (c)(1),
(2), (4) Date: Dec. 13, 2000

(87) PCT Pub. No.: WO99/65346

PCT Pub. Date: Dec. 23, 1999

(30) Foreign Application Priority Data

Jun. 15, 1998 (FR) ..... 98 07719

(51) Int. Cl.[7] ..... A42B 9/02
(52) U.S. Cl. ..... 2/109; 2/69; 2/400; 2/228
(58) Field of Search ..... 2/69–73, 75, 78.1–78.3, 2/79, 80, 83, 109, 113, 114, 227, 228, 234, 238, 400–403, 405, 406, 408; 450/102–105

(56) References Cited

U.S. PATENT DOCUMENTS

| | | | | | |
|---|---|---|---|---|---|
| 1,255,718 | A | * | 2/1918 | Doty | 2/78.1 |
| 2,282,218 | A | * | 5/1942 | Flesh | 2/403 |
| 2,352,128 | A | | 6/1944 | Shikles | |
| 2,602,928 | A | * | 7/1952 | Chatfield | 2/403 |
| 2,623,210 | A | * | 12/1952 | Chatfield | 2/403 |
| 3,220,410 | A | * | 11/1965 | Sloan | 2/403 |
| 3,398,739 | A | * | 8/1968 | Marino | 2/403 |
| 5,537,691 | A | | 7/1996 | Inzer | |
| 5,790,984 | A | * | 8/1998 | Doubleday | 2/69 |
| 6,047,408 | A | * | 4/2000 | Brill, Jr. | 2/403 |

FOREIGN PATENT DOCUMENTS

| | | |
|---|---|---|
| DE | 23 08 589 A | 8/1974 |
| FR | 791 007 A | 11/1935 |
| FR | 2 738 997 A | 3/1997 |
| WO | 95/02340 A | 1/1995 |

* cited by examiner

*Primary Examiner*—Gloria M. Hale
(74) *Attorney, Agent, or Firm*—Davis & Bujold, P.L.L.C.

(57) ABSTRACT

The present invention relates to a sports garment making it possible to urinate without having to undress and ensure that it is comfortable for a sportsman, and in particular for a cyclist. The sports garment (10), particularly for a cyclist, comprises a front part (2) and a back part (3), and is characterized in that the front part (2) presents an horizontal opening for said cyclist to take out his penis so as to facilitate the cyclist's micturition. The opening is delimited by an external flap (11*a*) and an internal flap (11*b*) provided on the front part (2) and which overlap so that the opening remains closed without the help of any fastening mechanism.

14 Claims, 1 Drawing Sheet

SPORTSWEAR, IN PARTICULAR, FOR A CYCLIST

The present invention relates to a sports garment, in particular for a cyclist, comprising a back part and a front part, said front part presenting an opening located substantially level with the pubis to allow the cyclist to take out his penis.

BACKGROUND OF THE INVENTION

Such a sports garment can be a cycling-suit with either long or short legs or what cyclists call cycling shorts or "boxer" shorts. At present, these garments do not have an opening allowing the sportsman to urinate. Therefore, the sportsman has to undress. This is particularly a nuisance for the sportsman, as he has to wriggle and writhe to remove his garment and therefore he wastes time. Furthermore, as the sportsman is undressed, he might catch cold.

There are known garments in other clothing fields, which have a fly, fastened by buttons, press-studs or a zipper. Such garments are notably described in publications U.S. Pat. No. 2,352 128, DE-A-2308 589 or FR-A-2 738 997. Publication WO-A-95/02340, also deals with bodysuit style garments, provided with a lower part which is detachable and fixed to the upper part of the garment by means of press-studs or a Velcro® strip.

For reasons of decency and practically, these zips or the lower detachable part absolutely have to have fastening means.

However, these fastening means are a particular nuuisance for a garment designed for use by cyclists. Indeed, fastening means like these, particularly press-studs, represent a great risk of injury when the cyclist is sitting on his bike.

Finally, the bodysuit type fastening systems, such as described in the international publication WO-A-95/02340, can not be used for cyclist's garments as it would not then be possible to keep the chamois leather in place, which must be present on this type of garment for the cyclist's comfort. Furthermore, this fastening system would not be very practical to use on a bike.

SUMMARY OF THE INVENTION

The present invention aims to overcome these drawbacks by proposing a sports garment making it possible to urinate without having to undress and whilst remaining comfortable for a sportsman, particularly for a cyclist sitting on his bike.

With this aim in mind, the invention relates to a garment of the type mentioned in the preamble, characterized in that the opening is horizontal and in that the front part comprises an external flap and an internal flap which overlap to delimit said opening so that said opening remains closed without the help of any fastening means whatsoever.

The external and internal flaps can be provided substantially over the whole width of the front part and be pinched in lateral seams between the front and back parts.

Advantageously, the external and internal flaps are fitted to the front part by seams, which follow a rounded line.

The external and lower flaps can comprise holding stiches, which can be advantageously oblique.

The present invention and its advantages shall be more fully disclosed in the following description of an example of embodiment, with reference to the attached drawings, in which:

Figure 1:
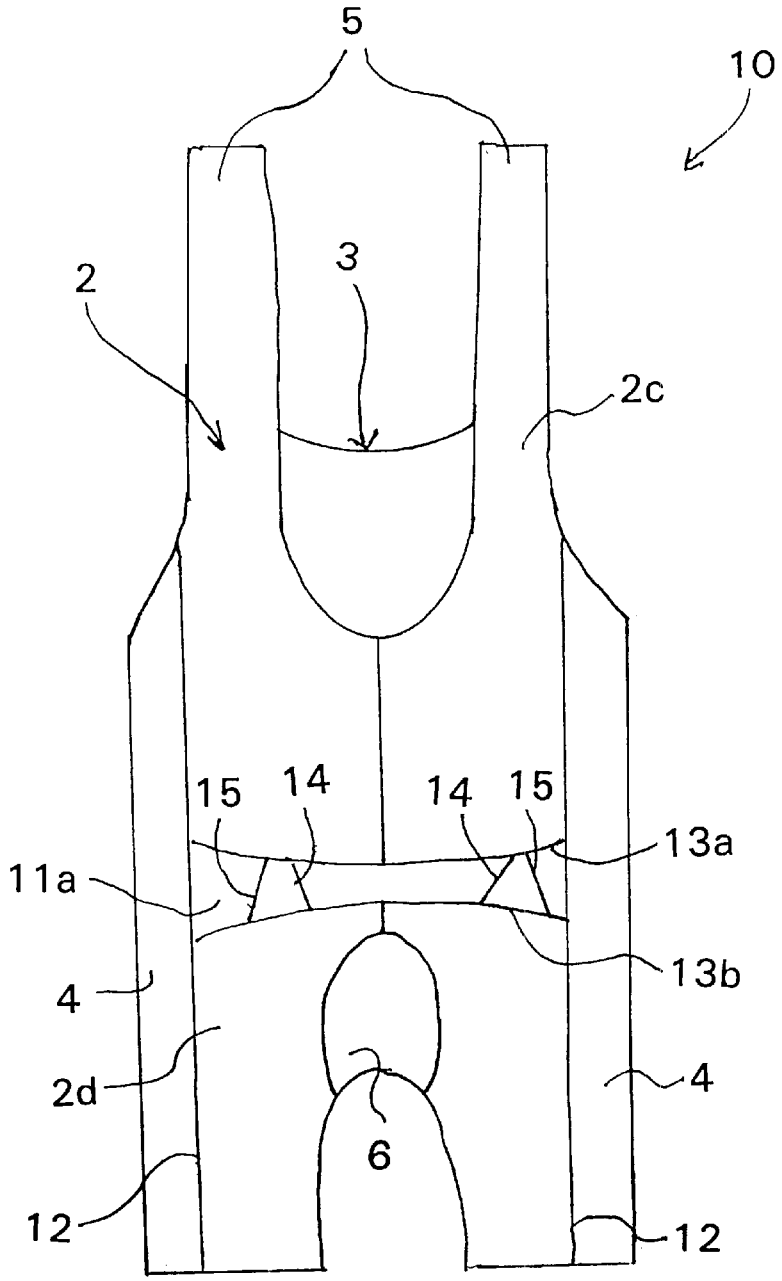
FIG. 1 represents a front view of a sports garment according to the present invention.
Figure 2:
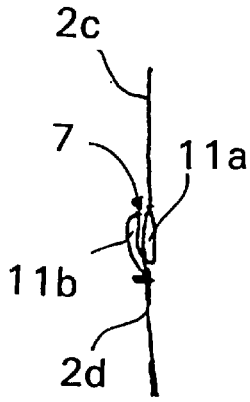
FIG. 2 represents a transversal cutaway view of FIG. 1.

In accordance with the present invention, the front part 2 of the cycling shorts 10 is divided above the chamois leather 6 and substantially level with the pubis, into two parts, one upper part 2*c* and one lower part 2*d*, the upper part 2*c* ending with an external flap 11*a* and the lower part 2*d* starting with an internal flap 11*b*. The external flap 11*a* and internal flap 11*b* overlap and delimit a horizontal opening 7 through which the cyclist can take out his penis.

The external flap 11*a* and internal flap 11*b* extend over the whole width of the front part 2 and their lateral edges are pinched in the lateral seams 12 which make it possible to fit the front part 2 to the lateral strips 4.

The external flap 11*a* and internal flap 11*b* are also held together by two oblique holding stitches 14 in order to respect the elasticity of the fabric used. These holding stitches 14 also form a flared passage making it easy for the cyclist to insert his penis.

Two holding stitches 15 are also provided and arranged obliquely in the opposite direction to the stitches 14. These stitches 15 are provided to prevent the wind from rushing into the cycling shorts.

The sports garment described above offers the sportsman the advantage of being able urinate during his sports activity without having to undress. Indeed, with an conventional pair of cycling shorts for example, the braces have to be removed to lower the top of the garment enough to be able to urinate. With the garment according to the invention, the sportsman simply has to partly open the opening 7 and place his penis in this opening 7 to be able to urinate.

Furthermore, the opening 7 according to the invention presents the advantage of not opening unintentionally, due to the overlapping flaps 11*a*, 11*b* and does not require any fastening means. There is therefore no risk of injuring the cyclist as the external flap 11*a* and internal flap 11*b* do not bother the cyclist or cause him any discomfort when he is sitting on his bike.

The above description clearly shows that the invention achieves all the advantages being sought.

DESCRIPTION OF THE PREFERRED EMBODIMENTS

The present invention is not limited to the example of embodiment described and can be extended to any modification and alternative which is obvious for an expert. The invention can in particular also be applied to other types of sports garments than the cycling shorts shown, and particularly to "boxer" shorts, i.e. cycling shorts with long legs, or suits with short or long legs.

What is claimed is:

1. A sports garment (10), comprising:

a front portion (2) connected by a pair of braces extending over the shoulders of a wearer to a back portion (3);

a passage formed in the front portion (2) of the sports garment substantially adjacent the pubis of the wearer, the passage delineated by a curved upper seam and a curved lower seam extending substantially horizontally across an entire width of the front portion;

an external flap (11*a*) extending from the lower seam partially overlaps an internal flap (11*b*) extending from the curved upper seam, the internal and external flaps being joined to one another by at least a first and a second spaced apart holding seams extending obliquely between the curved upper seam and curved lower seam to maintain the passage in a closed position without the help of any fastening means, until manipulated by the wearer into an open position for purposes of micturition; and wherein the curved upper seam and the curved lower seam are concavely stitched relative to one another across a width of the front part to ensure that the substantially horizontally extending opening (7), remains closed without the help of any fastening means.

2. A sports garment (10), comprising;

a front part (2) and a back part (3), the front part (2) having an external flap **(11*a*) partially overlapping an internal flap (11*b*), and delimiting a substantially horizontally extending opening (7)** located substantially proximate with the pubis of the wearer;

a first curved seam **13*a* attaches the external flap (11*a*)** to the front part and extends substantially horizontally between a spaced apart first and second side seams;

a second curved seam **13*b* attaches the internal flap (11*b*) to the front part and extends substantially horizontally between the spaced apart first and second side seams; and wherein the first and second curved seams are concavely stitched relative to one another across a width of the front part to ensure that the substantially horizontally extending opening (7)**, remains closed without the help of any fastening means.

3. The sports garment (10) according to claim 2, wherein the external flap **(11*a*) and internal flap (11*b*) extend substantially over a whole width of the front part (2)**.

4. The sports garment (10) according to claim 2, wherein said external flap **(11*a*) and internal flap (11*b*) are attached by at least a first and second holding stitches (14, 15)**.

5. The sports garment (10) according to claim 4, wherein said holding stitches (14, 15) extend at an oblique angle between the first and second curved seams.

6. The sports garment (10) according to claim 2, wherein the front part (2) is connected with the back part by a pair of braces (5) extending over the shoulders of the wearer.

7. The sports garment (10) according to claim 2, wherein the sports garment is made of spandex.

8. A sports garment (10), comprising a front part (2) and a back part (3), the front part (2) having an external flap **(11*a*) partially overlapping an internal flap (11*b*), and delimiting an opening (7), the opening (7) located substantially proximate with the pubis of the wearer, remains closed without the help of any fastening means, and the external flap (11*a*) and internal flap (11*b*) are fitted to the front part (2) by seams (13*a*, 13*b*)** along a curved line.

9. The sports garment (10) according to claim 8, wherein the external flap **(11*a*) and internal flap (11*b*)** extend substantially over a whole width of the front part.

10. The new sports garment (10) according to claim 9, wherein said external flap **(11*a*) and internal flap (11*b*) are held by lateral seams between the front (2) and back (3)** parts.

11. The new sports garment (10) according to claim 8, wherein said external flap **(11*a*) and internal flap (11*b*) have holding stitches (14, 15)**.

12. The new sports garment (10) according to claim 11, wherein said holding stitches (14, 15) are oblique.

13. The sports garment (10) according to claim 8, wherein the front part (2) extend over the shoulders of the wearer to the back part (3) forming a plurality of braces (5).

14. The sports garment (10) according to claim 8, wherein the sports garment is made of spandex.

* * * * *